US011721936B2

(12) United States Patent
Attarzadeh et al.

(10) Patent No.: US 11,721,936 B2
(45) Date of Patent: Aug. 8, 2023

(54) CONTACT ELEMENT FOR ELECTRICALLY INTERCONNECTING AN ELECTRICAL CONDUCTOR AND A CONNECTION PART OF AN ELECTRICAL SYSTEM, AND METHOD FOR PRODUCING SAID ELEMENT

(71) Applicant: Auto-Kabel Management GmbH, Hausen i.W. (DE)

(72) Inventors: Amir Hossein Attarzadeh, Mönchengladbach (DE); Franz-Heinz Kaszubowski, Wassenberg (DE)

(73) Assignee: Auto-Kabel Management GmbH, Hausen i.W. (DE)

( * ) Notice: Subject to any disclaimer, the term of this patent is extended or adjusted under 35 U.S.C. 154(b) by 152 days.

(21) Appl. No.: 17/285,821

(22) PCT Filed: Nov. 6, 2019

(86) PCT No.: PCT/EP2019/080312

§ 371 (c)(1),
(2) Date: Apr. 15, 2021

(87) PCT Pub. No.: WO2020/094677

PCT Pub. Date: May 14, 2020

(65) Prior Publication Data

US 2021/0384668 A1 Dec. 9, 2021

(30) Foreign Application Priority Data

Nov. 8, 2018 (DE) ..... 10 2018 127 899.3

(51) Int. Cl.
*H01R 13/405* (2006.01)
*H01R 13/52* (2006.01)

(52) U.S. Cl.
CPC ..... *H01R 13/5219* (2013.01); *H01R 13/405* (2013.01); *H01R 13/5213* (2013.01)

(58) Field of Classification Search
CPC ..... H01R 13/5219; H01R 13/405; H01R 13/5213; H01R 11/12
See application file for complete search history.

(56) References Cited

U.S. PATENT DOCUMENTS 4,199,214 A 4/1980 Pearce, Jr. et al.
4,842,540 A * 6/1989 Endo ..... B29C 45/1615 264/273

(Continued)

FOREIGN PATENT DOCUMENTS

CN 1518163 A 8/2004
CN 107342468 A 11/2017

(Continued)

OTHER PUBLICATIONS

Cohausz & Florack, U.S. Appl. No. 17/286,040 and preliminary amendment, filed Apr. 16, 2021, 32 pages.

(Continued)

*Primary Examiner* — Tho D Ta
(74) *Attorney, Agent, or Firm* — Sunstein LLP

(57) ABSTRACT

The invention relates to a contact element (2) for electrically contacting an electrical conductor (4) to a connection part (40) of an electrical system (42), in particular an electrical system of a motor vehicle, with the electrical conductor (4), which is sheathed with a conductor insulation (6), and with a cable lug (10, 10', 10", 10'"), which is connected in an electrically conductive manner to the electrical conductor (4) and comprises a contact part (11), wherein the cable lug (10, 10', 10", 10'") and a section (14) of the electrical conductor (4) attached thereto are overmoulded with an electrically insulating housing (16) in such manner that a part (17) of the contact part (11) is exposed, wherein the (Continued)

housing (16) has a channel (20, 26), which runs from an opening (22, 28) of the housing (16) to the exposed part (17) of the contact part (11), and wherein a sealing element (30) is injection-moulded onto the housing (16) to seal a closure (44, 34), in particular a cover (34), which can be used to close the opening (22, 28). The invention further relates to a method for producing such a contact element.

17 Claims, 10 Drawing Sheets

(56) References Cited

U.S. PATENT DOCUMENTS

| | | | | |
|---|---|---|---|---|
| 5,334,039 | A * | 8/1994 | Kanda | H01R 13/5216 264/273 |
| 5,346,408 | A | 9/1994 | Chupak | |
| 5,588,883 | A | 12/1996 | Hattori | |
| 5,906,495 | A | 5/1999 | Morgan | |
| 5,922,263 | A * | 7/1999 | Endo | H01R 13/504 264/273 |
| 5,993,233 | A * | 11/1999 | Fukuda | H01R 13/5221 439/271 |
| 6,225,000 | B1 | 5/2001 | Pavlik et al. | |
| 6,250,973 | B1 | 6/2001 | Lowery et al. | |
| 6,428,364 | B2 | 8/2002 | Saito et al. | |
| 6,902,434 | B2 | 6/2005 | Stack | |
| 7,192,319 | B1 | 3/2007 | Rahman et al. | |
| 7,306,475 | B2 * | 12/2007 | Tsuruta | H01R 4/30 439/364 |
| 7,530,843 | B1 * | 5/2009 | Tesfay | H01R 13/521 439/587 |
| 8,152,574 | B2 * | 4/2012 | Matsuoka | H01R 4/302 439/587 |
| 9,312,646 | B2 * | 4/2016 | Kuji | H01R 13/639 |
| 9,325,363 | B2 * | 4/2016 | Ferraro | H01R 13/5213 |
| 9,847,593 | B2 * | 12/2017 | Nunner | H01R 13/42 |
| 10,062,974 | B2 * | 8/2018 | Okamoto | H01R 4/34 |
| 2006/0079138 | A1 | 4/2006 | Zhao et al. | |
| 2007/0207652 | A1 | 9/2007 | Tsuruta | |
| 2010/0075535 | A1 | 3/2010 | Mizutani et al. | |
| 2013/0189860 | A1 | 7/2013 | Pyrono | |
| 2016/0043500 | A1 | 2/2016 | Mori et al. | |
| 2016/0294107 | A1 | 10/2016 | Trimborn | |
| 2017/0279216 | A1 | 9/2017 | Thurn | |
| 2018/0294605 | A1 | 10/2018 | Iizuka et al. | |
| 2021/0384651 | A1 * | 12/2021 | Attarzadeh | H01R 4/70 |

FOREIGN PATENT DOCUMENTS

| | | | | |
|---|---|---|---|---|
| DE | 20 2006 013 652 | U1 | 11/2006 | |
| DE | 10 2014 216762 | A1 | 2/2016 | |
| DE | 10 2016 100978 | A1 | 10/2016 | |
| EP | 1 054 461 | A2 | 11/2000 | |
| EP | 1 439 614 | A1 | 7/2004 | |
| JP | H0594960 | U | 12/1993 | |
| JP | H11167911 | A | 6/1999 | |
| JP | 2001023720 | A | 1/2001 | |
| JP | 2003-217703 | A | 7/2003 | |
| JP | 3504839 | B2 * | 3/2004 | |
| WO | WO 2008/025159 | A1 | 3/2008 | |
| WO | WO 2014/132907 | A1 | 9/2014 | |
| WO | WO-2014178292 | A1 * | 11/2014 | H01R 13/504 |

OTHER PUBLICATIONS

International Searching Authority/EP, International Search Report and Written Opinion of the International Searching Authority, Application No. PCT/EP2019/080312, dated Feb. 5, 2020, with English translation of the International Search Report, 16 pages.

International Preliminary Examining Authority/EP, Written Opinion of the International Preliminary Examining Authority, Application No. PCT/EP2019/080312, dated Oct. 9, 2020, 8 pages, in German.

International Preliminary Examining Authority /EP, International Preliminary Report on Patentability, Application No. PCT/EP2019/080312, dated Feb. 15, 2021, 25 pages, in German.

German Patent Office, Office Action, Application No. 10 2018 127 899.3, dated Jun. 28, 2019, 6 pages, in German.

Chinese Patent Office, Office Action for Chinese Patent Application 201980073350.1 dated Jul. 5, 2022, 19 pages.

National Intellectual Property Administration, PRC, Notification of the Second Office Action, Application No. 201980073350.1, dated Feb. 10, 2023, 18 pages.

* cited by examiner

CONTACT ELEMENT FOR ELECTRICALLY INTERCONNECTING AN ELECTRICAL CONDUCTOR AND A CONNECTION PART OF AN ELECTRICAL SYSTEM, AND METHOD FOR PRODUCING SAID ELEMENT

CROSS-REFERENCE TO RELATED APPLICATIONS

This application is the national phase entry of international patent application no. PCT/EP2019/080312 filed Nov. 6, 2019 and claims the benefit of German patent application No. 10 2018 127 899.3, filed Nov. 8, 2018, the disclosures of which are incorporated herein by reference in their entirety.

TECHNICAL FIELD

The invention relates to a contact element for electrically contacting an electrical conductor to a connection part of an electrical system, in particular of an electrical system of a motor vehicle, with the electrical conductor, which is sheathed with a conductor insulation, and with a cable lug, which is connected in an electrically conductive manner to the electrical conductor and comprises a contact part, wherein the cable lug and a section of the electrical conductor attached thereto are overmoulded with an electrically insulating housing in such manner that a part of the contact part is exposed and wherein the housing has a channel, which runs from an opening of the housing to the exposed part of the contact part. Such a contact element can for example be used to produce a watertight screw contact between an electrical conductor and a connection part of an electrical system.

BACKGROUND ART

In order to produce a watertight contacting of an electrical conductor to a connection part, housings are known in the market, which are placed onto the conductor and a cable lug attached thereto. In order to achieve a watertight sealing between conductor and housing, a single-wire sealing is typically inserted into the housing. Indeed, a watertight contacting can be achieved in this way. The mounting of these housings is, however, very complex and requires a significant amount of installation space.

Furthermore, a contact element for contacting an electrical conductor to a connection part is known from DE 10 2013 021 409 A1. The access to the contact element is ensured by a channel provided in the housing such that the contact part can be screwed through the channel by means of a screw to a connection part of an electrical device. Then, the channel can be sealed off by screwing in or snapping in a sealing cap. It is proposed in DE 10 2013 021 409 A1 to overmould the cable lug with the material of the housing. Indeed mounting effort and installation space can be reduced in this way. However, it has been found that it is not easy to produce a watertight housing in this manner.

In the context of the present invention, it has in particular been found that the sealing of a channel of a housing overmoulded around the cable lug by screwing in or snapping in a sealing cap in some cases may be inadequate. In particular, the materials that can be used for overmoulding a cable lug in order to achieve the mechanical properties required for the housing are not optimal for reliable sealing.

Against this background, the object underlying the present invention is to provide an improved contact element for electrically contacting an electric conductor to a connection part of an electrical system and a method for producing the same, by means of which a reliable sealing with a smallest possible installation space can be achieved with cost-effective production.

SUMMARY OF THE INVENTION

This object is achieved, according to the invention, with a contact element for electrically contacting an electrical conductor to a connection part of an electrical system, in particular an electrical system of a motor vehicle, with the electrical conductor, which is sheathed with a conductor insulation, and with a cable lug, which is connected in an electrically conductive manner to the electrical conductor and comprises a contact part, when the cable lug and a section of the electrical conductor attached thereto are overmoulded with an electrically insulating housing in such manner that a part of the contact part is exposed and when the housing has a channel, which runs from an opening of the housing to the exposed part of the contact part, in that a sealing element is injection-moulded onto the housing to seal a closure, which can be used to close the opening. The closure can for example be a cover or an element of the connection part, such as for example a base which can be inserted into the channel.

By moulding on such a sealing element, sufficient adhesion is achieved between housing and sealing element. Moreover, the choice of material for the sealing element can be adapted to the purposes of sealing that are to be met, in particular for reliable sealing between the housing and a closure, in particular a cover, to close the opening.

With respect to a method, the above-mentioned object is further achieved by a method for producing the previously described contact element, in which are provided an electrical conductor, which is sheathed with a conductor insulation, and a cable lug, which is connected in a conductive manner to the electrical conductor and comprises a contact part, in which the cable lug and a section of the electrical conductor attached thereto are overmoulded with an electrically insulating housing in such manner that a part of the contact part is exposed, when the overmoulding is carried out such that a channel is formed which runs from an opening of the housing to the exposed part of the contact part and in which a sealing element is injection moulded onto the housing to seal a closure, in particular a cover, which can be used to close the opening.

The cable lug is connected in an electrically conductive manner to the electrical conductor, in particular to an end of the electrical conductor. For this purpose, the cable lug preferably has a connection region to connect to an electrical conductor.

The connection between the cable lug and the electrical conductor may for example be a weld connection, in particular an ultrasonic weld connection. For this purpose, the connection region can be formed for example as a flat region, on which the electrical conductor is welded. In order to improve a weld connection, a metallic contact layer can be applied in the contact region, for example by friction coating, in particular as described in DE 10 2014 011 887 A1.

Furthermore, the cable lug can be crimped with the electrical conductor.

The electrical conductor is in particular a cable, preferably a stranded conductor, for example with copper strands or aluminium strands.

The cable lug has a contact part. The contact part is in particular the part of the cable lug, which is provided to contact a connection part of an electrical system. The contact part preferably has a flat shape with an opening to introduce a connection element to connect the contact part to a connection part.

The cable lug can as a whole be formed flat such that the contact part and connection region lie substantially in one plane. The connection region can, however, also lie in a different plane to the contact part. For example, an angled cable lug can be used.

The housing has a channel, which runs from an opening of the housing to the exposed part of the contact part. In this way, there is access to the exposed part of the contact part from the outside such that the contact part can be connected to a connection part of an electrical system. The housing can in particular have a sockelt, in which the channel is formed.

A sealing element is moulded onto the housing to seal a closure which can be used to close the opening. The sealing element ensures that reliable sealing takes place when closing the opening with a closure which can be used for such purpose, for example a cover or a part of the connection part, such as for example a base which can be introduced into the channel, such that water cannot enter into the channel. The sealing element can in particular be arranged, for example in the region of the opening. Alternatively, it is conceivable that the sealing element is moulded onto the housing in the region around the opening. If the housing for example has a socket with the channel, the sealing element can then in particular be moulded into the or onto the socket.

The sealing element can in particular be provided for a radial and/or axial sealing, in relation to the extension direction of the channel. For a radial sealing, the sealing element can for example be arranged on the channel wall of the channel such that a closure is sealed in the radial direction. For an axial sealing, the sealing element can for example be arranged around the opening of the housing, for example on a front end of a support of the housing comprising the channel. The sealing element can in particular also be provided for radial and axial sealing, for example in that it extends from the channel wall of the channel out from the channel to the front end of a socket of the housing comprising the channel.

The sealing element preferably consists of a different material to the housing. A softer material, in particular a material with lower Shore hardness than the housing can in particular be used for the sealing element. In this way, a harder material can at the same time be used for the housing to achieve the desired mechanical properties and a softer material can be used for the sealing element to achieve a reliable sealing.

Shore hardness is understood as the Shore hardness, measured according to DIN 53505.

The sealing element can preferably have one or a plurality of, in particular circular sealing lips, which surround the channel and/or the opening.

Different embodiments of the contact element and the method for producing the same are described below, with the individual embodiments each applying independently of one another both to the contact element and also to the method. Moreover, the individual embodiments can also be combined with one another.

In a first embodiment, the housing has a first channel, which runs from a first opening of the housing to the exposed part of the contact part, and a second channel, which runs from a second opening of the housing to the exposed part of the contact part. In a corresponding embodiment of the method, the overmoulding with the housing is carried out in such manner that a first channel is formed, which runs from a first opening of the housing to the exposed part of the contact part, and a second channel is formed, which runs from a second opening of the housing to the exposed part of the contact part.

In this way, two-sided access to the contact part is enabled in order to connect the contact part to a connection part of an electrical system. In particular, a connection part with a threaded bolt or a threaded drill hole can be introduced through a channel and a nut or screw corresponding thereto can be introduced through the other channel.

The sealing element is preferably provided to seal the channel, which is closed with a cover after establishing the fixation thereof. Additionally or alternatively, the sealing element can, however, also be provided to seal the channel, through which the contact part is contacted with a connection part, in particular to seal a connection part of an electrical system introduced into the channel, for example a base.

In a further embodiment, the housing and the sealing element are produced by multi-component injection moulding. In a corresponding embodiment of the method, multi-component injection moulding is carried out, wherein in a first injection-moulding step the housing is produced and in a second injection-moulding step the sealing element is produced. Multi-component injection moulding enables a particularly economic production of the contact element with different materials. For the first injection-moulding step, the electrical conductor provided with the cable lug attached thereto is arranged in a first injection-moulding tool and are overmoulded with a first material to produce the housing. In the second injection-moulding step, the overmoulded conductor with cable lug is preferably arranged in a second injection-moulding tool and the sealing element or the sealing elements are moulded onto the housing. The multi-component injection-moulding can in particular be carried out on an injection-moulding system with a plurality of plasticisation units.

In a further embodiment, the conductor insulation consists of a thermoplastic elastomer, in particular of a thermoplastic polyurethane, and the housing consists of a thermoplastic elastomer, in particular a thermoplastic polyurethane. In this way, the materials used for the conductor insulation and the housing are adapted to one another such that when the electrical conductor sheathed with the conductor insulation is overmoulded with the housing, a watertight sealing is produced between the housing and the conductor insulation of the electrical conductor. In this way, a single-wire sealing can in particular be dispensed with.

For the housing, a thermoplastic elastomer, in particular thermoplastic polyurethane, which has a greater Shore hardness than the material of the conductor insulation is preferably used. Conductor insulation made of thermoplastic elastomer typically has quite a low Shore hardness, for example Shore A80 to enable flexible laying of the conductor. Therefore, for the production of a dimensionally-stable housing, a thermoplastic elastomer, in particular thermoplastic polyurethane, with a greater Shore hardness, for example Shore D60 or more, is preferably used.

In a further embodiment, the contact element comprises a cover, with which the opening is closable. The cover is preferably connected by a holding element, for example a thread-like holding element, to the housing so as to be undetachable. The sealing element and the cover are in particular adapted to one another in such manner that the sealing element and the cover seal the opening. If the contact element has a first channel with a first opening and a second channel with a second opening, then the contact element in particular comprises a cover, with which the first opening is closable. The second opening can be closed during installation of the contact element by a connection element of an electrical system, to which the contact part is connected.

In a further embodiment, the cover is at least in parts formed from a different material to the housing, in particular from a material with a higher Shore hardness than the housing. In this way, the sealing of the channel can be improved even further by the interaction of the cover with the sealing element. This is in particular advantageous when a thermoplastic elastomer, in particular a thermoplastic polyurethane, is used for the housing since even polyurethanes with a high Shore hardness are not necessarily hard enough to produce a reliable sealing cover. Polyamide has for example been found to be a suitable material for the cover.

The cover produced from a material different to the housing is preferably connected to the housing so as to be undetachable. For this purpose, a holding means can be provided, for example a thread-like holding means, to which the cover is connected, for example by a positive connection.

In a further embodiment, the cover and the housing have complementary securing means for the frictional and/or positive fixing of the cover on the housing. For example, the cover can have one or a plurality of tabs and the housing catch lugs complementary thereto such that the cover can be fixed by snapping the catch lugs into the tabs on the housing. The cover and the housing can also have threads complementary to one another in order to fix the cover on the housing. Through the complementary securing means, incorrect positioning of the cover can also be constructively prevented. Moreover, the snapping-in of the securing means leads to haptic feedback that indicates to the user that the cover is fully and correctly closed.

Visual markers can also be provided on the cover and/or on the housing which visually signal to the user whether the cover is correctly positioned or closed. Furthermore, mismatch-preventing elements can be provided on the housing, for example position-coded lugs (e.g. PokaYoke), which match with correspondingly coded openings on the connection part such that mismatching can be prevented when assigning the connection element to the correct connection part. For mismatch-preventing elements of this type, it is advantageous when a harder material is used for the housing, in particular with a higher Shore hardness than the conductor insulation such that the mismatch-preventing elements prevent the contacting of the contact element with an incorrect connection part reliably and even when applying high mounting force.

In a further embodiment, the electrical conductor and the cable lug are welded to one another, in particular ultrasonically welded. In this way, an installation space-saving connection between conductor and cable lug can be produced. In this embodiment, it is particularly advantageous when a thermoplastic polyurethane is used for the housing. Weld connections cannot typically be perfectly formed in terms of size such that thickness fluctuations of the overmoulded housing may result at the weld connection. In the case of wall thickness-critical plastics such as polyamide, certain jumps in wall thickness caused by a lack of size accuracy of the weld connection can lead to leaks. In contrast, thermoplastic polyurethanes are less prone to wall thickness fluctuations and material accumulations such that even with process-related variations in the position of the weld connection a leak-tight housing is ensured.

In a further embodiment, the cable lug is crimped with the electrical conductor, preferably only in the non-insulated part of the electrical conductor. While normal crimp connections typically also comprise insulation crimping, in which crimping is also carried out in the insulated region of the conductor to stabilise the cable lug on the conductor, in the present case crimping around the insulation can be dispensed with since the overmoulding with the housing ensures a sufficient stabilisation of the crimped connection between cable lug and conductor. In this way, a more compact and flatter construction of the crimping and a better overmoulding due to improved flow behaviour of the plastic is possible because of the reduced flow resistance through the lack of insulation crimping.

In a further embodiment, the contact part of the cable lug has one or a plurality of openings, through which the housing and/or the sealing element are injected. The provision of such openings in the contact part leads to stronger anchoring of the contact part in the housing or in the sealing element such that the contact part, even in the case of stronger mechanical loading, for example when connecting the contact part to a connection part, does not come out of the overmoulded housing. The openings are preferably closed in the circumferential direction and can be formed for example as round, oval or elongated holes.

In a corresponding embodiment of the method, the contact part of the cable lug has one or a plurality of openings, which are filled with the material of the housing during injection moulding of the housing and/or with the material of the sealing element during injection moulding of the sealing element. In this way, the contact part is reliably anchored in the housing in a positive manner.

In a further embodiment, the sealing element moulded onto the housing extends from the first channel through an opening of the contact part to the second channel. In a corresponding embodiment of the method, the contact part of the cable lug has one or a plurality of openings, which remain open when the housing is injection moulded and are filled with the material of the sealing element when the sealing element is injection moulded. The sealing element in particular extends from the first channel through the opening of the contact part to the second channel. In this way, the injection-moulding process is simplified since with an injection gate from one side of the contact part, for example into the first channel, a sealing element can be moulded onto the housing, which also extends to the other side of the contact part, for example into the second channel, since the plastic can reach the other side of the contact part during injection moulding through the opening of the contact part.

Further features and advantages of the contact element and of the method will emerge from the following description of exemplary embodiments, with reference being made to the enclosed drawing.

DETAILED DESCRIPTION OF SPECIFIC EMBODIMENTS

Figure 1A:
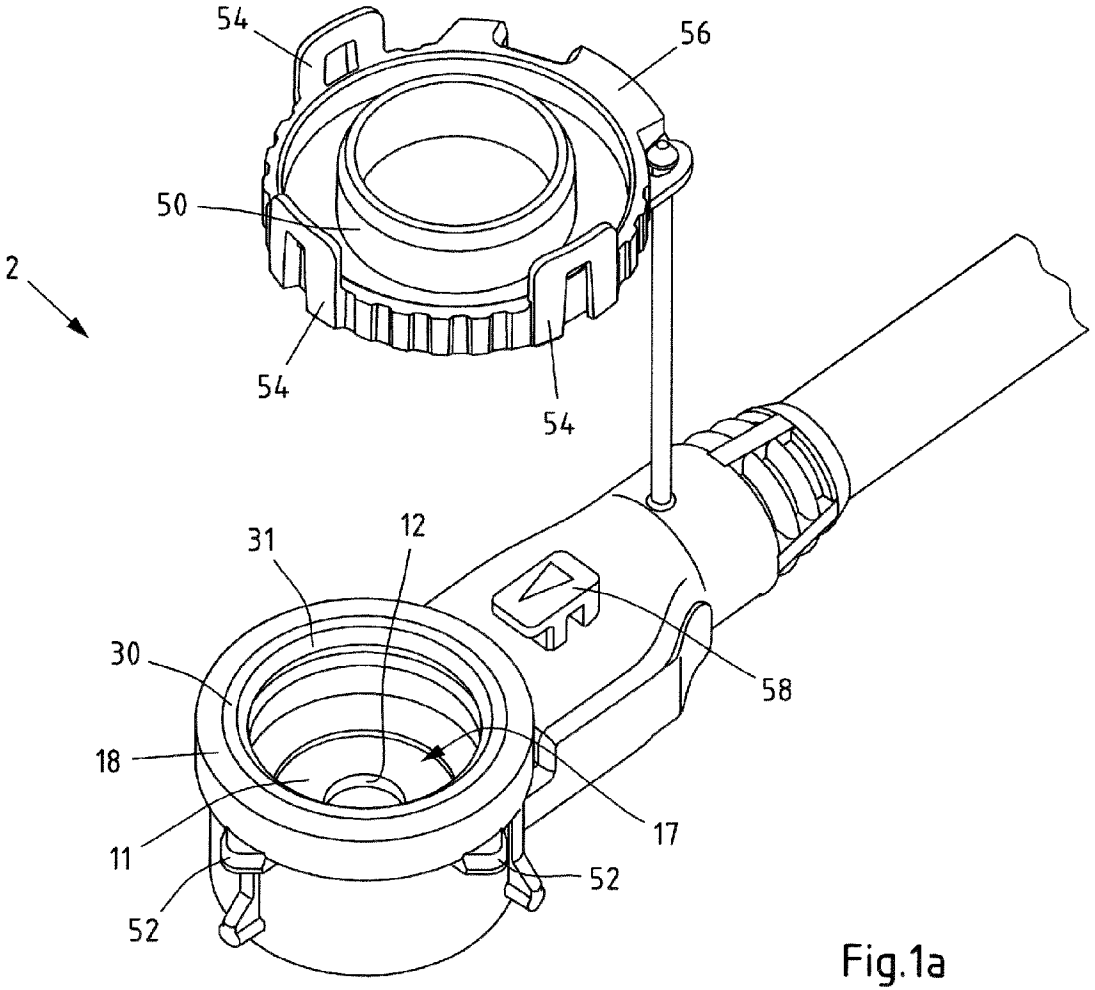
FIG. 1*a-b* show an exemplary embodiment of the contact element.
Figure 1B:
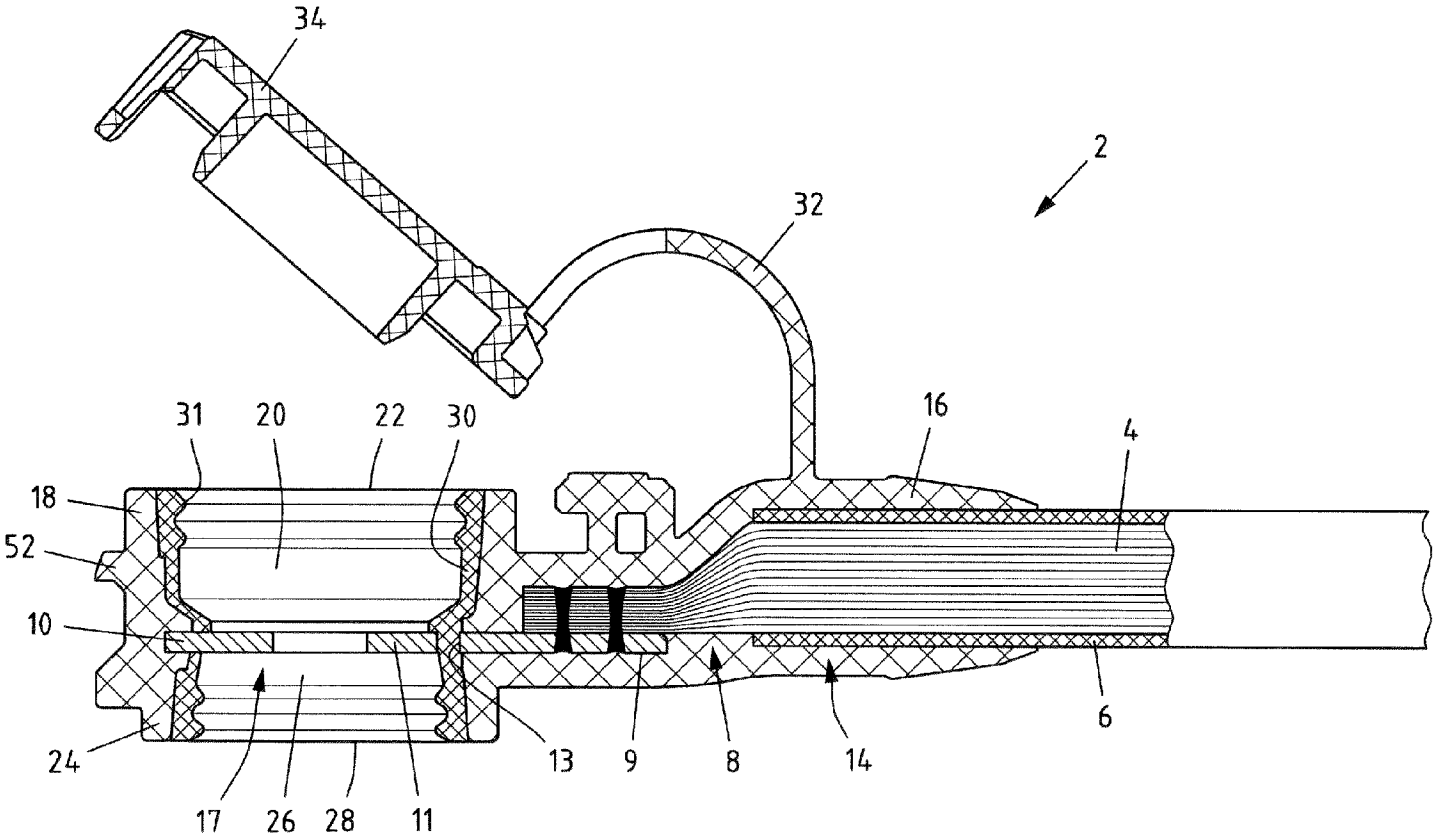

FIGS. 1*a-b* show an exemplary embodiment of the contact element in an isometric view (FIG. 1*a*) and sectional view (FIG. 1*b*).

The contact element 2 comprises an electric conductor 4, which is sheathed with a conductor insulation 6 made of quite soft polyurethane with the Shore hardness A80. One end 8 of the conductor 4 is stripped and connected by means of ultrasonic welding (in FIG. 1*b* illustrated schematically by two black bars) in an electrically conductive manner to a connection region 9 of a cable lug 10. The cable lug 10 has a flat circular contact part 11 with a central drill hole 12 and a plurality of smaller openings 13 arranged around it.

The cable lug 10 and a section 14 of the electrical conductor 4 attached thereto is overmoulded with an electrically insulating housing 16 made of polyurethane, with a part 17 of the contact part 11 with the drill hole 12 being exposed.

The housing 16 forms a first socket 18 with a first channel 20, which runs from a first opening 22 of the housing to the exposed part 17 of the contact part 11, and a second socket 24 with a second channel 26, which runs from a second opening 28 of the housing 16 to the exposed part 17 of the contact part 11.

A sealing element 30 with circular sealing lips 31 is injection-moulded onto the housing 16 in the first and second channel 20, 26 which consists of a softer plastic than the housing 16, for example of thermoplastic polyethylene.

A cover 34 is connected to the housing so as to be undetachable via a thread-shaped holding element 32. The cover 34 consists of a harder material than the housing, for example of polyamide and is latched via a positive connection with the end of the thread-shaped holding element 32.

The shape of the cover 34 is adapted to the shape of the first support 18 such that the cover 34 can be placed on the first support 18 in order to close the opening 22.

Figure 2A:
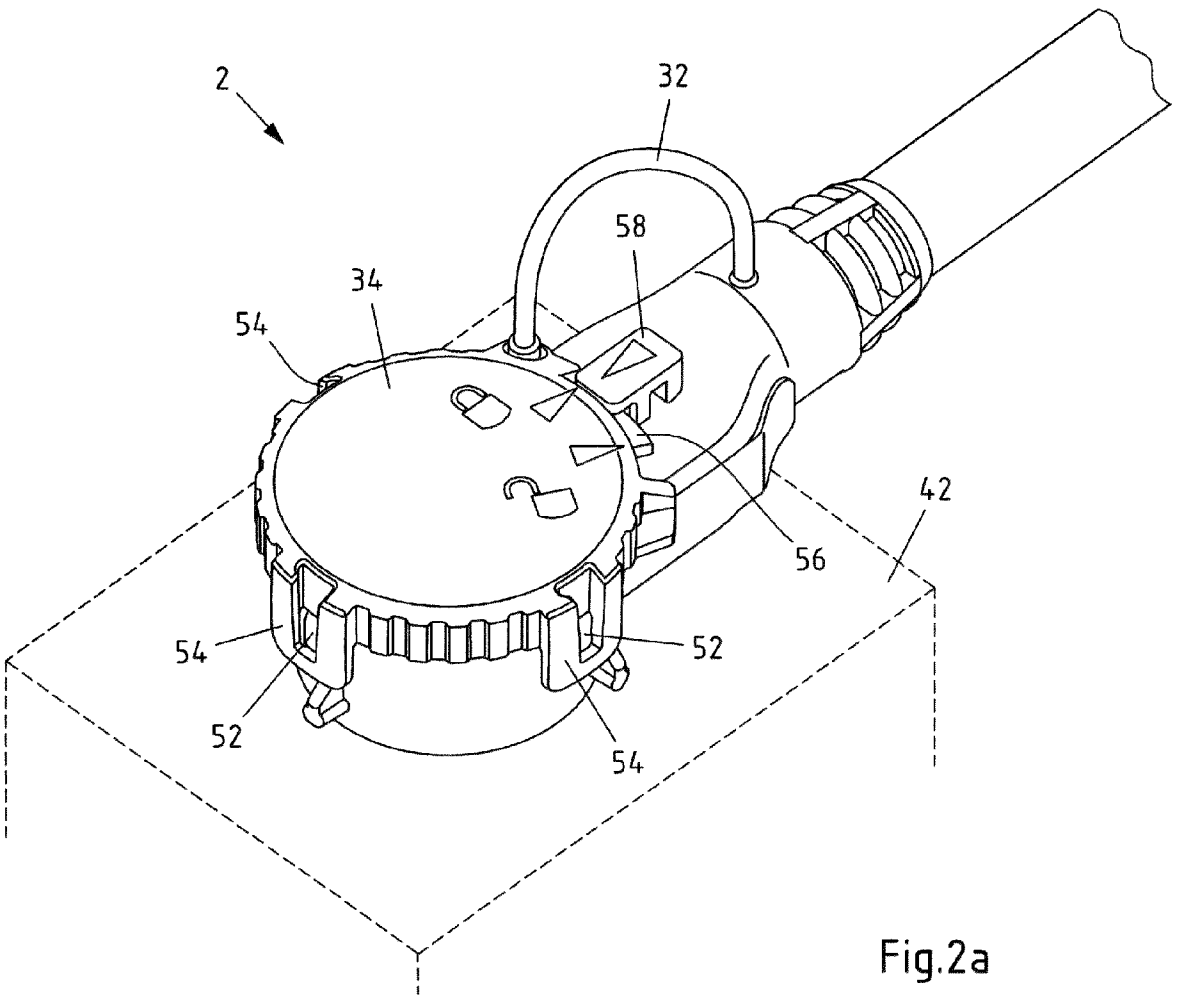
FIG. 2*a-b* show the contact element from FIG. 1*a-b* after establishing an electrical contacting with a connection part of an electrical system.
Figure 2B:
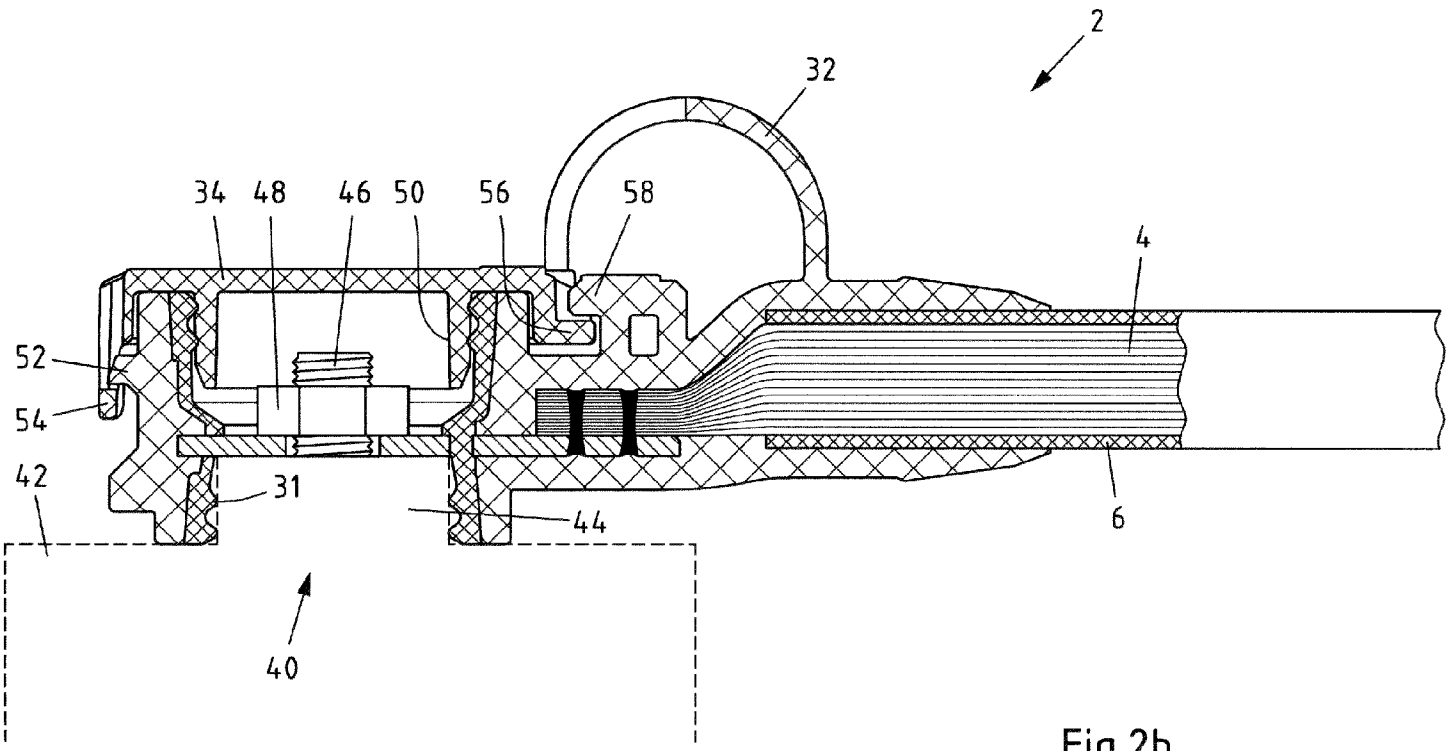

FIG. 2*a-b* show the contact element 2 from FIG. 1*a* after connecting to a connection part 40 of an electrical system 42 of a motor vehicle, namely in an isometric view (FIG. 2*a*) and in a sectional view (FIG. 2*b*). The connection part 40 has a slightly conical and electrically insulating base 44 with an electrically conductive threaded bolt 46 made of metal. When being connected, the contact element 2 with the second channel 26 is put over the base 44 such that the threaded bolt 46 is guided through the drill hole 12 of the contact part 11 of the cable lug 10. The threaded bolt can be secured with a nut 48 through the first channel 20.

The sealing element 30 presses with the sealing lips 31 in the second channel on the outer side of the base 44 and, as a result, seals the contact element 2 from the second opening 28. The sealing from the first opening 22 takes place by placing the cover 34 on the first support 18, with the sealing element 30 pressing with the sealing lips 31 on the outer side of an inner contour 50 of the cover 34 and, as a result, causes a water-tight sealing.

To securely fix the cover 34 on the housing 16, the cover 34 and the housing 16 have complementary securing means in the form of catch lugs 52 on the first support 18 and tabs 54 on the cover 34, and the catch lugs 52 can be snapped into the tabs 54 by rotating the cover 34 that is in place. As further complementary securing means, a locking element 56 is provided on the cover 34 and a corresponding undercut 58 is provided on the housing 16 which engage under one another when rotating the cover 34 and prevent accidental falling of the cover 34 from the housing 16.

The contact element 2 enables a secure and tight contacting of the electrical conductor 4 with the connection part 40 of the electrical system 42. In particular, the overmoulded housing made of thermoplastic polyurethane leads to a tight connection with the conductor insulation 6. The material of the sealing element 30 that is softer compared to the housing 16 leads to good sealing of the exposed part 17 of the contact part 11 from both sides, and namely in particular in combination with the material of the cover 34 and of the base 44, which material is harder compared to the housing 16. The material of the housing 16 is, in contrast, hard enough to ensure a dimensionally stable housing and in particular to cause the positive securing of the cover 34 on the housing 16 by the catch lugs 52 and the undercut 56.

It has been found that the contact part 2 has a higher degree of water-tightness (e.g. with respect to water and steam jet). The assembly of the contact part 2 and the connection part 40 attached thereto can even be submerged without water entering. Therefore, the contact part 2 is suitable in particular for applications in motor vehicles, in which it may be exposed to moisture and spraying water.

A contact part connected to a connection part even allows this assembly to be submerged.

Figure 3A:
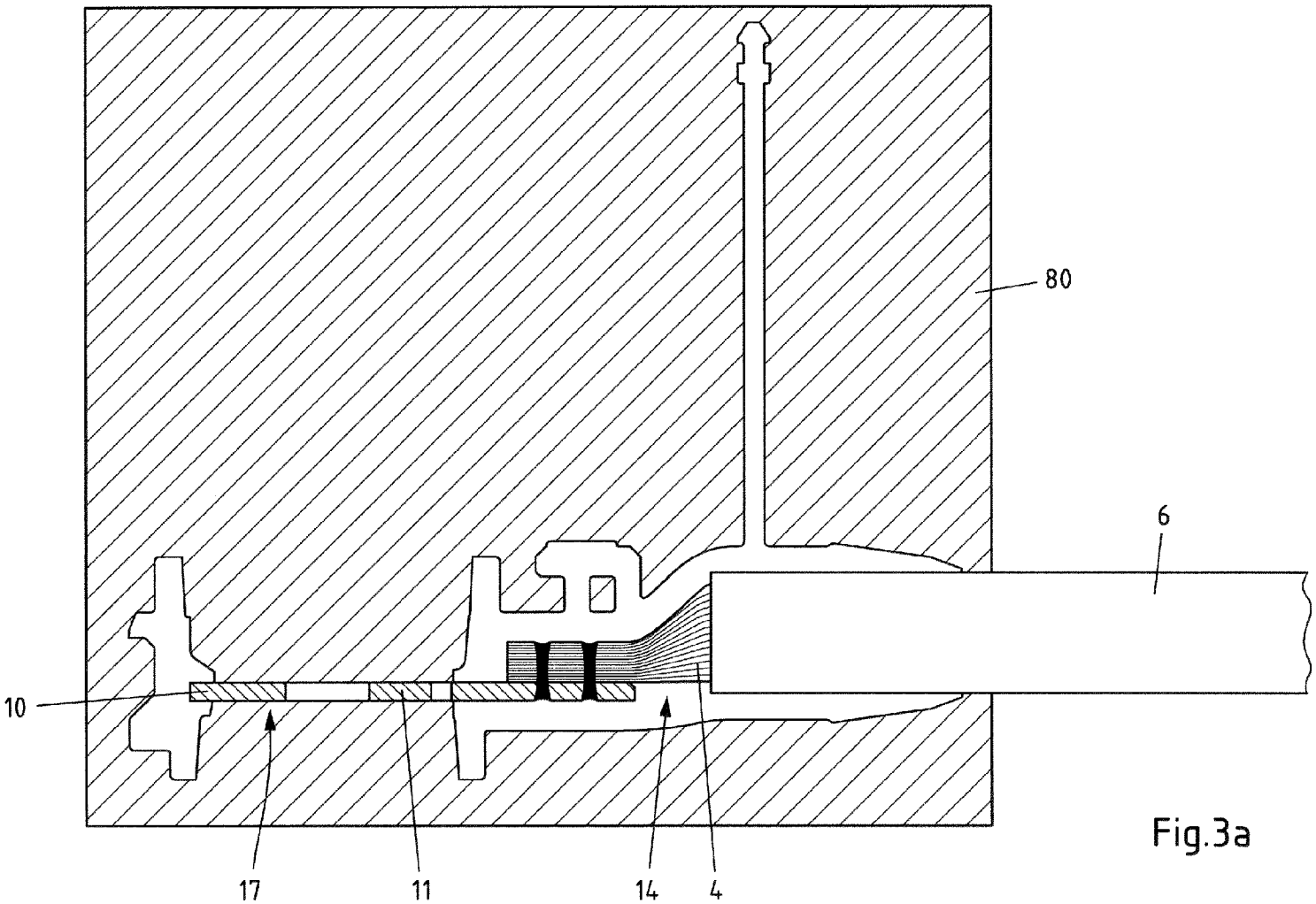
FIG. 3*a-b* show an exemplary embodiment of the method for producing the contact element from FIG. 1*a-b* and FIG. 4*a-d* show cable lugs for different exemplary embodiments of the contact element.
Figure 3B:
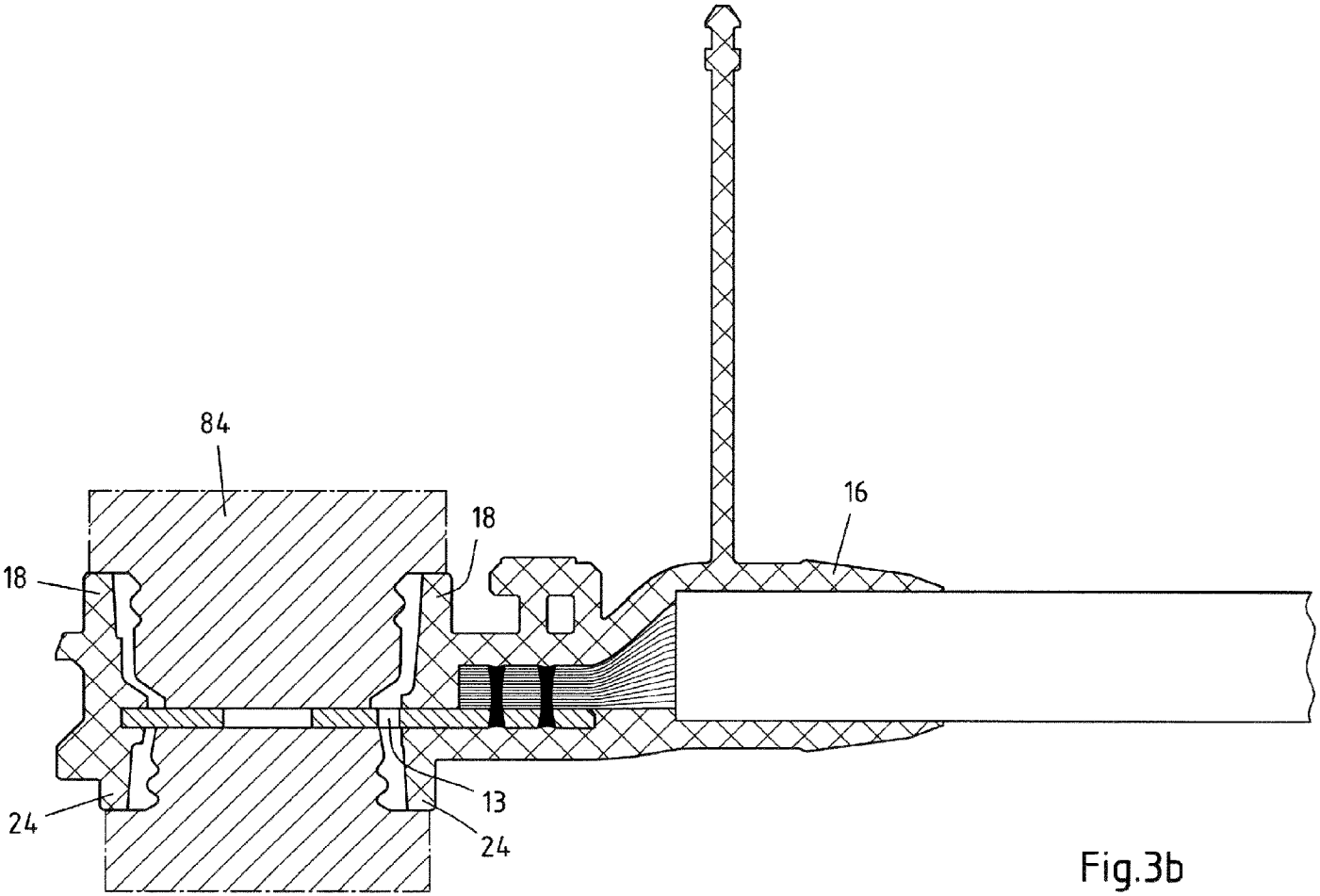

FIGS. 3*a-b* illustrate an exemplary embodiment of the method for producing the contact element 2 from FIG. 1*a* in a schematic sectional representation.

In a first step of the method, the conductor 4 sheathed with the conductor insulation 6 and attached to the cable lug 10 by ultrasonic welding is provided and is arranged in a first injection mould 80 as shown in FIG. 3*a*. A first injection-moulding step takes place in the injection mould 80, in which the cable lug 10 and the section 14 of the electrical conductor 4 attached thereto are overmoulded with the housing 16 made of thermoplastic polyurethane and namely in such manner that the part 17 of the contact part 11 with the drill hole 12 of the cable lug 10 remains exposed, the first and second base 18, 24 with the channels 20, 26 are produced and one or a plurality of openings 12 remain open.

The structural part 82 produced in this way is then arranged in a second injection mould 84 as shown in FIG. 3*b*, in which a second injection moulding step is then carried out, where the sealing element 30 is moulded onto the housing 16.

Through the previously open openings 13, the material injection moulded in the second injection moulding step can reach both sides of the contact part 11 without two-sided injection moulding being required. In this way, the production method is simplified.

After the second injection moulding step, the separately produced cover 34 is connected to the holding element 32 to complete the contact element represented in FIG. 1*a*.

FIGS. 4*a-d* show cable lugs for different exemplary embodiments of the contact elements in an isometric view.

Figure 4A:
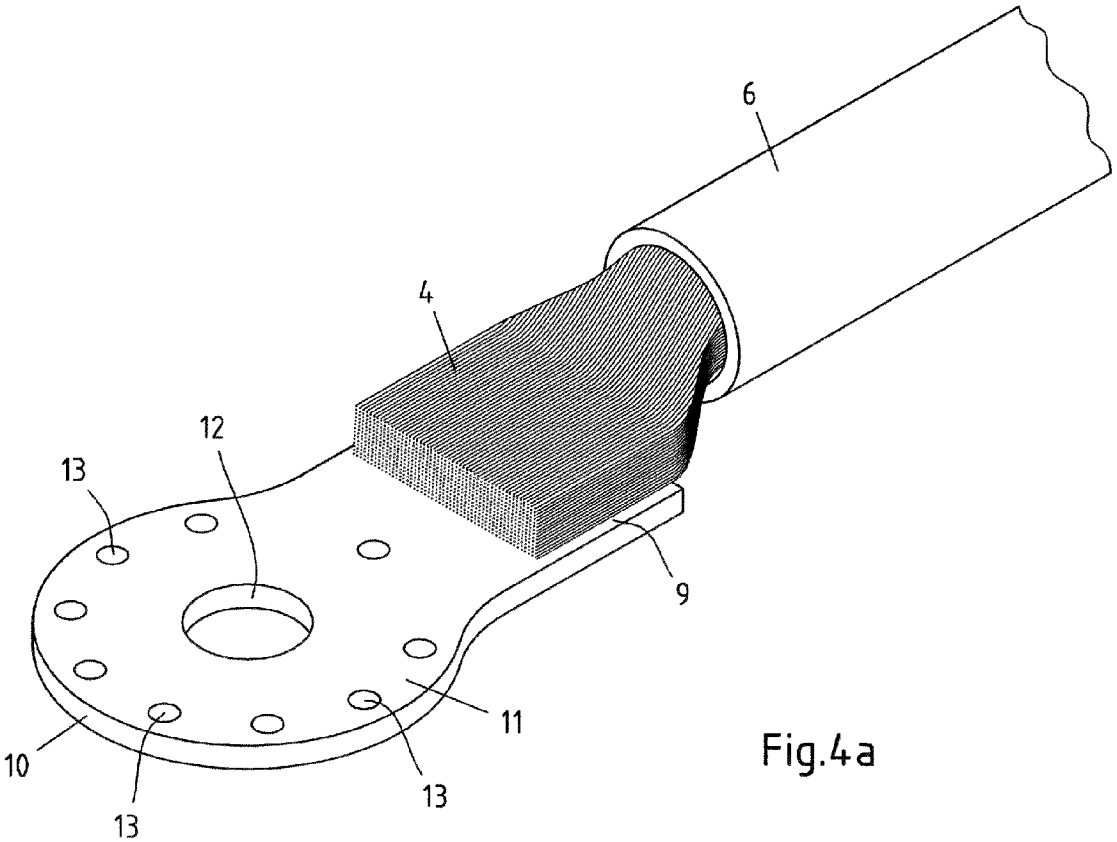

FIG. 4*a* shows the cable lug 10 of the contact element 2 from FIG. 1*a*. The cable lug has a flat connection region 9, in which the conductor 4 is welded on, and a flat contact part 11 with the central drill hole 12 for the threaded bolt 46 and the openings 13 arranged around it to inject through the sealing element 30. When producing the contact element 2, some of the openings 13 can also be injected in the first injection moulding step with the material of the housing 16 and thus filled with the material of the housing 16. In this way, an improved anchoring of the contact part 11 in the housing 16 can be achieved. Furthermore, some of the openings, as described in connection with FIG. 3*a-b*, can remain open during the first injection moulding step and can be injected in the second injection moulding step with the material of the sealing element 30, whereby the production of the contact element 2 can be simplified.

Figure 4B:
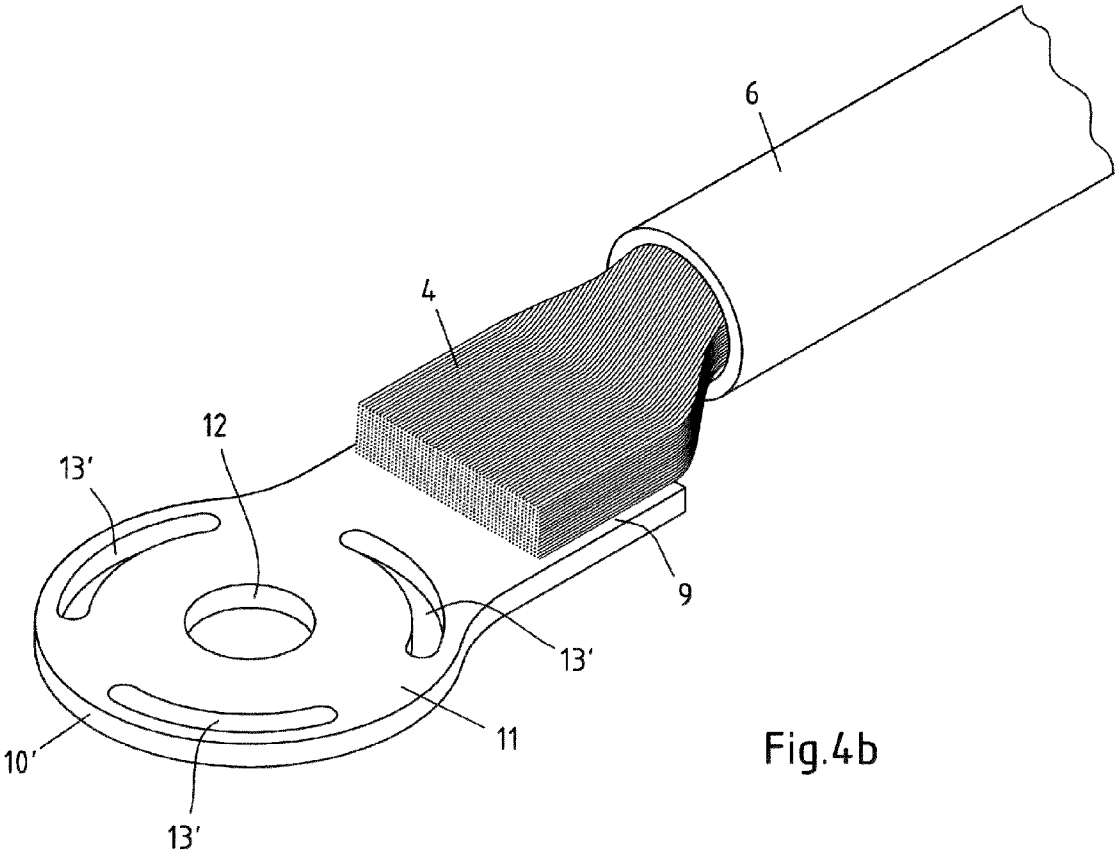

FIG. 4*b* shows an alternative cable lug 10', which differs from the cable lug 10 only by a different shape of the openings 13' which are formed elongated in FIG. 4*b*, while the openings 13' are formed round.

Figure 4C:
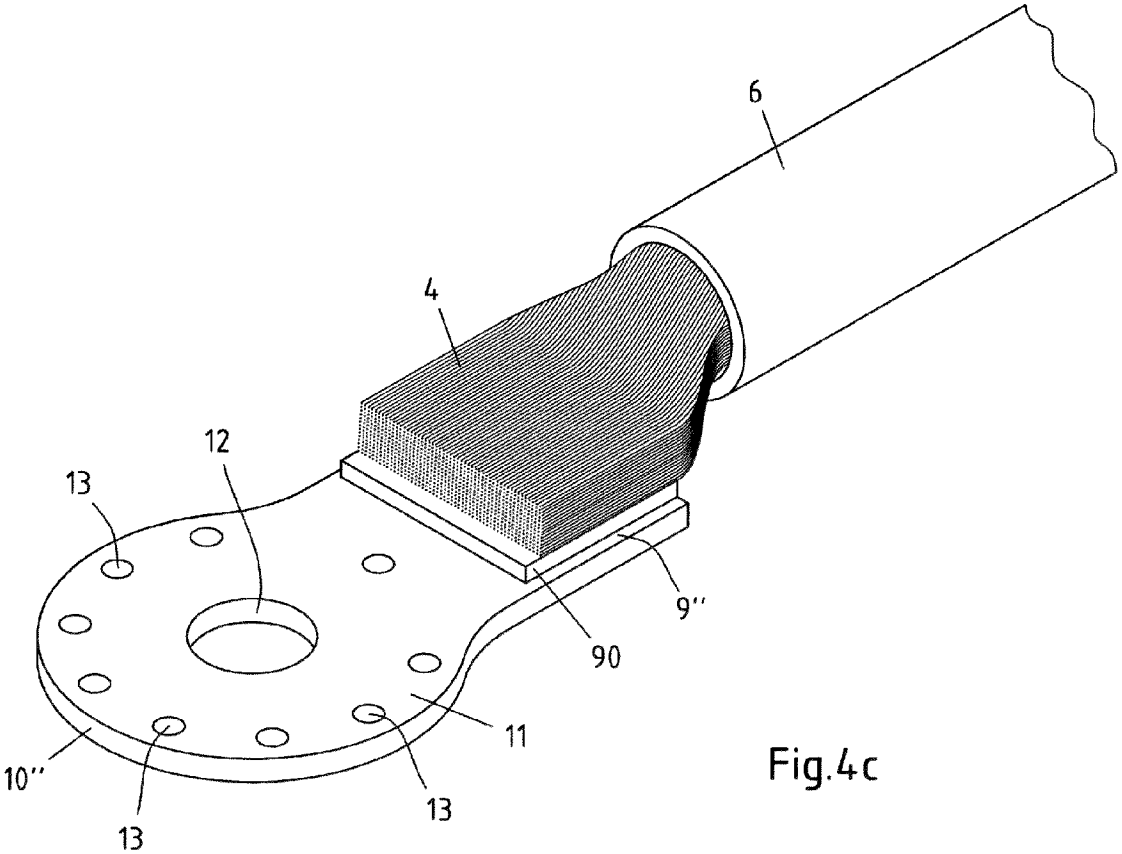

FIG. 4*c* shows a further alternative cable lug 10", which differs from the cable lug 10 only by a contact layer 90 applied on the connection part 9", which improves the weld connection to the conductor 4. The contact layer 90 can for example be applied by friction coating.

Figure 4D:
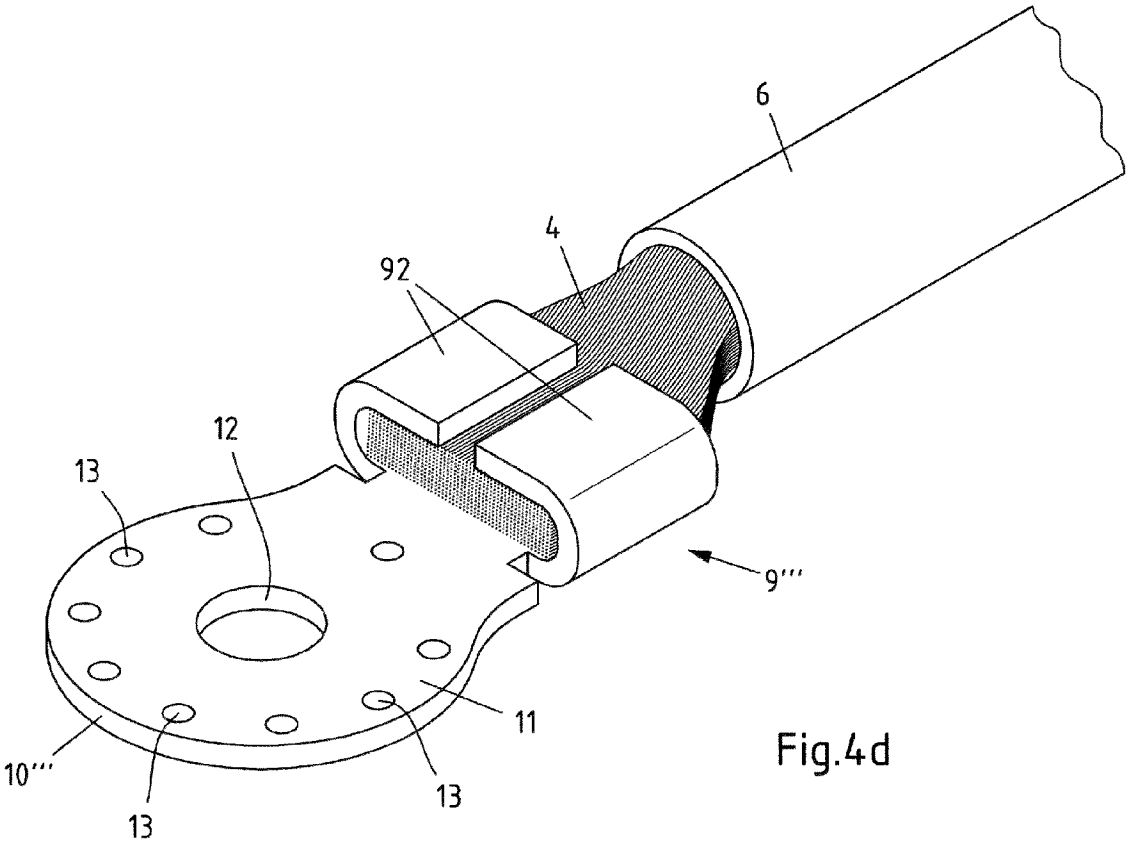

FIG. 4*d* shows a further alternative cable lug 10'", which differs from the cable lug 10 only in that the connection region 9'" is formed for a crimp connection. For this purpose, lateral crimp wings 92 are provided in the connection region 9'" which are crimped around the strands of the conductor 4.

The cable lug 10'" is crimped with the electrical conductor 4 only in the stripped part of the electrical conductor 4. The insulation crimping normally used for the crimp connection is not required for a contact element produced with the cable lug 10'" since sufficient stabilising of the crimping is achieved by the overmolded housing.

What is claimed is:

1. Contact element for electrically contacting an electrical conductor, which is sheathed with a conductor insulation, to a connection part of an electrical system of a motor vehicle, the contact element comprising:

a cable lug, which is connected in an electrically conductive manner to the electrical conductor and comprises a contact part;

an electrically insulating housing made of a thermoplastic elastomer overmoulded upon the cable lug and a section of the electrical conductor attached thereto in such manner that a part of the contact part is exposed and wherein the housing has a first channel, which runs from a first opening of the housing to the exposed part of the contact part;

a cover with which the first opening is closable, wherein the cover is formed at least partially of a harder material than the housing; and a sealing element injection-moulded onto the housing to seal the cover, wherein the sealing element and the cover are adapted to one another in such manner that the sealing element and the cover seal the first opening.

2. Contact element according to claim 1, wherein the conductor insulation consists of a thermoplastic elastomer, in particular thermoplastic polyurethane, and the housing consists of a thermoplastic elastomer, in particular thermoplastic polyurethane.

3. Contact element according to claim 1, wherein the cover is connected by a holding element to the housing so as to be undetachable.

4. Contact element according to claim 1, wherein the cover and the housing have complementary securing means for the frictional and/or positive fixing of the cover on the housing.

5. Contact element according to claim 1, wherein the electrical conductor and the cable lug are welded to one another, in particular ultrasonically welded.

6. Contact element according to claim 1, wherein the cable lug is crimped with the electrical conductor, preferably only in the non-insulated part of the electrical conductor.

7. Contact element according to claim 1, wherein the contact part of the cable lug has one or a plurality of openings through which the housing and/or the sealing element are injected.

8. Contact element according to claim 1, wherein the housing has a second channel which runs from a second opening of the housing to the exposed part of the contact part and wherein the sealing element is injection-moulded onto the housing at the first and/or second channel.

9. Contact element according to claim 8, wherein the sealing element injection-moulded onto the housing extends from the first channel through an opening of the contact part to the second channel.

10. Method for producing a contact element comprising:

providing an electrical conductor, which is sheathed with a conductor insulation, and a cable lug, which is connected in a conductive manner to the electrical conductor and comprises a contact part;

overmoulding the cable lug and a section of the electrical conductor attached thereto with a thermoplastic elastomer to produce an electrically insulating housing in such manner that a part of the contact part is exposed, wherein the overmoulding is carried out such that a channel is formed which runs from an opening of the housing to the exposed part of the contact part;

injection moulding a sealing element onto the housing to seal a cover, which can be used to close the opening; and connecting the cover to the housing by a holding element, wherein the cover is formed at least partially of a harder material than the housing.

11. Method according to claim 10, wherein multi-component injection moulding is carried out, wherein in the overmoulding is a first injection moulding act in which the housing is produced and the injection moulding of the sealing element is a second injection moulding act.

12. Method according to claim 11, wherein the contact part of the cable lug has one or a plurality of openings which are filled with the material of the housing during the first injection moulding act.

13. Method according to claim 11, wherein the contact part of the cable lug has one or a plurality of openings which remain open during the first injection moulding act and are filled with the material of the sealing element during the second injection moulding act.

14. Contact element for electrically contacting an electrical conductor, which is sheathed with a conductor insulation, to a connection part of an electrical system of a motor vehicle, the contact element comprising:

a cable lug, which is connected in an electrically conductive manner to the electrical conductor and comprises a contact part;

an electrically insulating housing overmoulded upon the cable lug and a section of the electrical conductor attached thereto in such manner that a part of the contact part is exposed and wherein the housing has a first channel, which runs from a first opening of the housing to the exposed part of the contact part;

a cover with which the first opening is closable; and a sealing element injection-moulded onto the housing to seal the cover, wherein the sealing element and the cover are adapted to one another in such manner that the sealing element and the cover seal the first opening;

wherein the contact part of the cable lug has one or a plurality of openings through which the housing and/or the sealing element are injected.

15. Contact element according to claim 14, wherein the housing has a second channel which runs from a second opening of the housing to the exposed part of the contact part and wherein the sealing element is injection-moulded onto the housing at the first and/or second channel, wherein the sealing element injection-moulded onto the housing extends from the first channel through one of the opening(s) of the contact part to the second channel.

16. Method for producing a contact element comprising:

providing an electrical conductor, which is sheathed with a conductor insulation, and a cable lug, which is connected in a conductive manner to the electrical conductor and comprises a contact part;

overmoulding the cable lug and a section of the electrical conductor attached thereto with an electrically insulating housing in such manner that a part of the contact part is exposed, wherein the overmoulding is carried out such that a channel is formed which runs from an opening of the housing to the exposed part of the contact part; and injection moulding a sealing element onto the housing to seal a cover, which can be used to close the opening;

wherein the overmoulding is a first injection moulding act in which the housing is produced from a material and the injection moulding of the sealing element is a second injection moulding act, wherein the contact part of the cable lug has one or a plurality of openings which are filled with the material of the housing during the first injection moulding act.

17. Method for producing a contact element comprising:

providing an electrical conductor, which is sheathed with a conductor insulation, and a cable lug, which is connected in a conductive manner to the electrical conductor and comprises a contact part;

overmoulding the cable lug and a section of the electrical conductor attached thereto with an electrically insulating housing in such manner that a part of the contact part is exposed, wherein the overmoulding is carried out such that a channel is formed which runs from an opening of the housing to the exposed part of the contact part; and injection moulding a sealing element onto the housing to seal a cover, which can be used to close the opening;

wherein the overmoulding is a first injection moulding act in which the housing is produced and the injection moulding of the sealing element is a second injection moulding act in which the sealing element is produced from a material, wherein the contact part of the cable lug has one or a plurality of openings which remain open during the first injection moulding act and are filled with the material of the sealing element during the second injection moulding act.

* * * * *